US011524873B2

(12) United States Patent
Roberts et al.

(10) Patent No.: US 11,524,873 B2
(45) Date of Patent: Dec. 13, 2022

(54) ROPELESS ELEVATOR WHEEL FORCE RELEASING SYSTEM

(71) Applicant: Otis Elevator Company, Farmington, CT (US)

(72) Inventors: Randy Roberts, Hebron, CT (US); Bruce Swaybill, Farmington, CT (US); Kiron Bhaskar, Farmington, CT (US); Brad Guilani, Woodstock Valley, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 109 days.

(21) Appl. No.: 17/062,042

(22) Filed: Oct. 2, 2020

(65) Prior Publication Data

US 2022/0106166 A1 Apr. 7, 2022

(51) Int. Cl.

| | |
|---|---|
| ***B66B 9/02*** | (2006.01) |
| ***B66B 11/00*** | (2006.01) |
| ***B66B 11/04*** | (2006.01) |

(52) U.S. Cl.

CPC ..... *B66B 9/02* (2013.01); *B66B 11/005* (2013.01); *B66B 11/043* (2013.01)

(58) Field of Classification Search

CPC ..... B66B 7/02; B66B 11/043; B66B 9/02; B66B 7/022; B66B 7/025; B66B 7/021; B66B 11/005

See application file for complete search history.

(56) References Cited

U.S. PATENT DOCUMENTS 5,713,432 A * 2/1998 Richter ..... B66B 11/0206 187/250

FOREIGN PATENT DOCUMENTS

| | | | | |
|---|---|---|---|---|
| JP | 01271387 A | * | 10/1989 | |
| JP | 04153179 A | * | 5/1992 | |
| JP | H07117951 A | * | 5/1995 | |
| JP | 2006082934 A | * | 3/2006 | ..... B66B 7/022 |

OTHER PUBLICATIONS

English Machine Translation of JPH 04-153179.*

* cited by examiner

*Primary Examiner* — Diem M Tran
(74) *Attorney, Agent, or Firm* — Cantor Colburn LLP

(57) ABSTRACT

According to an embodiment, an elevator system including: a beam climber system configured to move an elevator car through an elevator shaft by climbing a first guide beam that extends vertically through the elevator shaft, the first guide beam including a first surface and a second surface opposite the first surface, the beam climber system including: a first wheel in contact with the first surface; and a first electric motor configured to rotate the first wheel; and a wheel decompression system configured to move the first wheel away from the first guide rail.

17 Claims, 6 Drawing Sheets

ROPELESS ELEVATOR WHEEL FORCE RELEASING SYSTEM

BACKGROUND

The subject matter disclosed herein relates generally to the field of elevator systems, and specifically to a method and apparatus for alleviating pressure on wheels of elevator car propulsion systems.

Elevator cars are conventionally operated by ropes and counterweights, which typically only allow one elevator car in an elevator shaft at a single time. Ropeless elevator systems may allow for more than one elevator car in the elevator shaft at a single time.

BRIEF SUMMARY

According to an embodiment, an elevator system is provided. The elevator system including: a beam climber system configured to move an elevator car through an elevator shaft by climbing a first guide beam that extends vertically through the elevator shaft, the first guide beam including a first surface and a second surface opposite the first surface, the beam climber system including: a first wheel in contact with the first surface; and a first electric motor configured to rotate the first wheel; and a wheel decompression system configured to move the first wheel away from the first guide rail.

In addition to one or more of the features described herein, or as an alternative, further embodiments may include that the wheel decompression system includes: a first backup wheel operably connected to the first wheel such that when the first backup wheel moves away from the first guide beam the first wheel also moves away; and a first separating cam located between the first guide beam and a first guide rail of the elevator system, wherein the first separating cam is wedge shaped and configured to move the first backup wheel and the first wheel away from the first guide rail when the first backup wheel rolls onto the separating cam.

In addition to one or more of the features described herein, or as an alternative, further embodiments may include: a first axle, wherein the first electric motor is located on the first axle, and wherein the first backup wheel is located on the first axle.

In addition to one or more of the features described herein, or as an alternative, further embodiments may include that the first separating cam is fixed and wedge shaped.

In addition to one or more of the features described herein, or as an alternative, further embodiments may include that the first separating cam further includes a first end and a second end opposite the first end, the first end having a first thickness and the second end having a second thickness, wherein the second thickness is greater than the first thickness.

In addition to one or more of the features described herein, or as an alternative, further embodiments may include that the first backup wheel rolls onto the separating cam at the first end.

In addition to one or more of the features described herein, or as an alternative, further embodiments may include that the first separating cam is wedge shaped.

In addition to one or more of the features described herein, or as an alternative, further embodiments may include that the first separating cam is adjustable to open and close, and wherein the first separating cam transforms into a wedge shape when opened.

In addition to one or more of the features described herein, or as an alternative, further embodiments may include that the first separating cam further includes a first end and a second end opposite the first end, wherein the first separating cam pivots at the first end to open.

In addition to one or more of the features described herein, or as an alternative, further embodiments may include that the beam climber system further includes: a first compression mechanism configured to compress the first wheel against the first surface.

In addition to one or more of the features described herein, or as an alternative, further embodiments may include that the wheel decompression system includes: a first expansion wheel operably connected to the first wheel such that when the first expansion wheel moves away from the first guide beam the first wheel also moves away, the first expansion wheel being configured to expand to compress the compression mechanism and push the first wheel away from the first guide beam to relieve pressure on the first wheel.

In addition to one or more of the features described herein, or as an alternative, further embodiments may include: a first axle, wherein the first electric motor is located on the first axle, and wherein the first expansion wheel is located on the first axle.

In addition to one or more of the features described herein, or as an alternative, further embodiments may include that the first expansion wheel further includes: a force actuator; and one or more drum wedges, wherein the force actuator is configured to actuate to expand the drum wedges to push the first expansion wheel away from the first guide beam.

In addition to one or more of the features described herein, or as an alternative, further embodiments may include that the first expansion wheel further includes: an engagement sensor configured to detect when the drum wedges are engaged with the first guide beam.

In addition to one or more of the features described herein, or as an alternative, further embodiments may include that the wheel decompression system includes: a first linear actuator operably connected to the first wheel such that when the linear actuator moves away from the first guide beam the first wheel also moves away, the first linear actuator being configured to expand to compress the compression mechanism and push the first wheel away from the first guide beam to relieve pressure on the first wheel.

In addition to one or more of the features described herein, or as an alternative, further embodiments may include that the first linear actuator further includes: a first control arm, wherein the first linear actuator is configured to actuate to expand the first control arm to push the first linear actuator away from the first guide beam.

In addition to one or more of the features described herein, or as an alternative, further embodiments may include that the wheel decompression system further includes: a first pivot arm including a first end, a second end located opposite the first end, and an intermediate point located between the first end and the second end; and a first support bracket operably connected to the first pivot arm at the first end, the first pivot arm being operably connected to the elevator car at the second end, wherein the first pivot arm is operably connected to the first wheel at the intermediate point, and wherein the first pivot arm is configured to pivot about the second end.

Technical effects of embodiments of the present disclosure include lifting one or more wheels of a beam climber system away from a guide beam to relieve pressure on the one or more wheels utilizing a wheel decompression system configured to move the wheels away from the guide rails.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
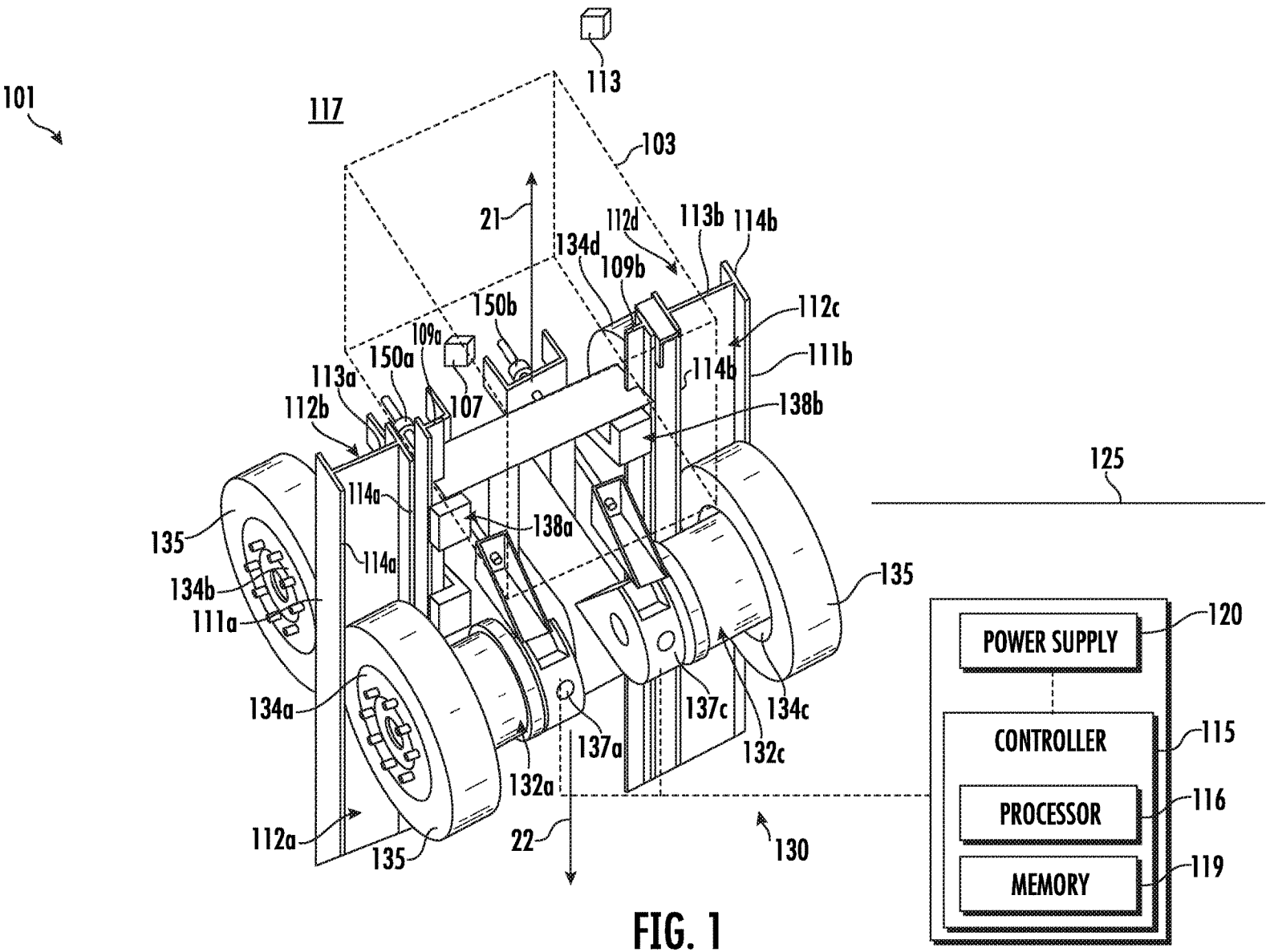
FIG. 1 is a schematic illustration of an elevator system with a beam climber system, in accordance with an embodiment of the disclosure.

FIG. 1 is a perspective view of an elevator system 101 including an elevator car 103, a beam climber system 130, a controller 115, and a power source 120. Although illustrated in FIG. 1 as separate from the beam climber system 130, the embodiments described herein may be applicable to a controller 115 included in the beam climber system 130 (i.e., moving through an elevator shaft 117 with the beam climber system 130) and may also be applicable to a controller located off of the beam climber system 130 (i.e., remotely connected to the beam climber system 130 and stationary relative to the beam climber system 130). Although illustrated in FIG. 1 as separate from the beam climber system 130, the embodiments described herein may be applicable to a power source 120 included in the beam climber system 130 (i.e., moving through the elevator shaft 117 with the beam climber system 130) and may also be applicable to a power source located off of the beam climber system 130 (i.e., remotely connected to the beam climber system 130 and stationary relative to the beam climber system 130).

The beam climber system 130 is configured to move the elevator car 103 within the elevator shaft 117 and along guide rails 109*a*, 109*b* that extend vertically through the elevator shaft 117. In an embodiment, the guide rails 109*a*, 109*b* are T-beams. The beam climber system 130 includes one or more electric motors 132*a*, 132*c*. The electric motors 132*a*, 132*c* are configured to move the beam climber system 130 within the elevator shaft 117 by rotating one or more wheels 134*a*, 134*b* that are pressed against a guide beam 111*a*, 111*b*. In an embodiment, the guide beams 111*a*, 111*b* are I-beams. It is understood that while an I-beam is illustrated, any beam or similar structure may be utilized with the embodiment described herein. Friction between the wheels 134*a*, 134*b*, 134*c*, 134*d* driven by the electric motors 132*a*, 132*c* allows the wheels 134*a*, 134*b*, 134*c*, 134*d* to climb up 21 and down 22 the guide beams 111*a*, 111*b*. The guide beam extends vertically through the elevator shaft 117. It is understood that while two guide beams 111*a*, 111*b* are illustrated, the embodiments disclosed herein may be utilized with one or more guide beams. It is also understood that while two electric motors 132*a*, 132*c* are illustrated visible, the embodiments disclosed herein may be applicable to beam climber systems 130 having one or more electric motors. For example, the beam climber system 130 may have one electric motor for each of the four wheels 134*a*, 134*b*, 134*c*, 134*d* (e.g., see FIG. 2, which illustrates a first electric motor 132*a*, a second electric motor 132*b*, a third electric motor 132*c*, and a fourth electric motor 132*d*). The electrical motors 132*a*, 132*c* may be permanent magnet electrical motors, asynchronous motor, or any electrical motor known to one of skill in the art. In other embodiments, not illustrated herein, another configuration could have the powered wheels at two different vertical locations (i.e., at bottom and top of an elevator car 103).

The first guide beam 111*a* includes a web portion 113*a* and two flange portions 114*a*. The web portion 113*a* of the first guide beam 111*a* includes a first surface 112*a* and a second surface 112*b* opposite the first surface 112*a*. A first wheel 134*a* is in contact with the first surface 112*a* and a second wheel 134*b* is in contact with the second surface 112*b*. The first wheel 134*a* may be in contact with the first surface 112*a* through a tire 135 and the second wheel 134*b* may be in contact with the second surface 112*b* through a tire 135. The first wheel 134*a* is compressed against the first surface 112*a* of the first guide beam 111*a* by a first compression mechanism 150*a* and the second wheel 134*b* is compressed against the second surface 112*b* of the first guide beam 111*a* by the first compression mechanism 150*a*. The first compression mechanism 150*a* compresses the first wheel 134*a* and the second wheel 134*b* together to clamp onto the web portion 113*a* of the first guide beam 111*a*. The first compression mechanism 150*a* may be a metallic or elastomeric spring mechanism, a pneumatic mechanism, a hydraulic mechanism, a turnbuckle mechanism, an electromechanical actuator mechanism, a spring system, a hydraulic cylinder, a motorized spring setup, or any other known force actuation method. The first compression mechanism 150*a* may be adjustable in real-time during operation of the elevator system 101 to control compression of the first wheel 134*a* and the second wheel 134*b* on the first guide beam 111*a*. The first wheel 134*a* and the second wheel 134*b* may each include a tire 135 to increase traction with the first guide beam 111*a*.

The first surface 112*a* and the second surface 112*b* extend vertically through the shaft 117, thus creating a track for the first wheel 134*a* and the second wheel 134*b* to ride on. The flange portions 114*a* may work as guardrails to help guide the wheels 134*a*, 134*b* along this track and thus help prevent the wheels 134*a*, 134*b* from running off track.

The first electric motor 132*a* is configured to rotate the first wheel 134*a* to climb up 21 or down 22 the first guide beam 111*a*. The first electric motor 132*a* may also include a first motor brake 137*a* to slow and stop rotation of the first electric motor 132*a*. The first motor brake 137*a* may be mechanically connected to the first electric motor 132*a*. The first motor brake 137*a* may be a clutch system, a disc brake system, a drum brake system, a brake on a rotor of the first electric motor 132*a*, an electronic braking, an Eddy current brakes, a Magnetorheological fluid brake or any other known braking system. The beam climber system 130 may also include a first guide rail brake 138*a* operably connected to the first guide rail 109*a*. The first guide rail brake 138*a* is configured to slow movement of the beam climber system 130 by clamping onto the first guide rail 109*a*. The first guide rail brake 138*a* may be a caliper brake acting on the first guide rail 109*a* on the beam climber system 130, or caliper brakes acting on the first guide rail 109 proximate the elevator car 103.

The second guide beam 111*b* includes a web portion 113*b* and two flange portions 114*b*. The web portion 113*b* of the second guide beam 111*b* includes a first surface 112*c* and a second surface 112*d* opposite the first surface 112*c*. A third wheel 134*c* is in contact with the first surface 112*c* and a fourth wheel 134*d* is in contact with the second surface 112*d*. The third wheel 134*c* may be in contact with the first surface 112*c* through a tire 135 and the fourth wheel 134*d* may be in contact with the second surface 112*d* through a tire 135. A third wheel 134*c* is compressed against the first surface 112*c* of the second guide beam 111*b* by a second compression mechanism 150*b* and a fourth wheel 134*d* is compressed against the second surface 112*d* of the second guide beam 111*b* by the second compression mechanism 150*b*. The second compression mechanism 150*b* compresses the third wheel 134*c* and the fourth wheel 134*d* together to clamp onto the web portion 113*b* of the second guide beam 111*b*. The second compression mechanism 150*b* may be a spring mechanism, turnbuckle mechanism, an actuator mechanism, a spring system, a hydraulic cylinder, and/or a motorized spring setup. The second compression mechanism 150*b* may be adjustable in real-time during operation of the elevator system 101 to control compression of the third wheel 134*c* and the fourth wheel 134*d* on the second guide beam 111*b*. The third wheel 134*c* and the fourth wheel 134*d* may each include a tire 135 to increase traction with the second guide beam 111*b*.

The first surface 112*c* and the second surface 112*d* extend vertically through the shaft 117, thus creating a track for the third wheel 134*c* and the fourth wheel 134*d* to ride on. The flange portions 114*b* may work as guardrails to help guide the wheels 134*c*, 134*d* along this track and thus help prevent the wheels 134*c*, 134*d* from running off track.

The second electric motor 132*c* is configured to rotate the third wheel 134*c* to climb up 21 or down 22 the second guide beam 111*b*. The second electric motor 132*c* may also include a third motor brake 137*c* to slow and stop rotation of the third motor 132*c*. The third motor brake 137*c* may be mechanically connected to the third motor 132*c*. The third motor brake 137*c* may be a clutch system, a disc brake system, drum brake system, a brake on a rotor of the second electric motor 132*c*, an electronic braking, an Eddy current brake, a Magnetorheological fluid brake, or any other known braking system. The beam climber system 130 includes a second guide rail brake 138*b* operably connected to the second guide rail 109*b*. The second guide rail brake 138*b* is configured to slow movement of the beam climber system 130 by clamping onto the second guide rail 109*b*. The second guide rail brake 138*b* may be a caliper brake acting on the first guide rail 109*a* on the beam climber system 130, or caliper brakes acting on the first guide rail 109*a* proximate the elevator car 103.

The elevator system 101 may also include a position reference system 113. The position reference system 113 may be mounted on a fixed part at the top of the elevator shaft 117, such as on a support or guide rail 109, and may be configured to provide position signals related to a position of the elevator car 103 within the elevator shaft 117. In other embodiments, the position reference system 113 may be directly mounted to a moving component of the elevator system (e.g., the elevator car 103 or the beam climber system 130), or may be located in other positions and/or configurations as known in the art. The position reference system 113 can be any device or mechanism for monitoring a position of an elevator car within the elevator shaft 117, as known in the art. For example, without limitation, the position reference system 113 can be an encoder, sensor, accelerometer, altimeter, pressure sensor, range finder, or other system and can include velocity sensing, absolute position sensing, etc., as will be appreciated by those of skill in the art.

The controller 115 may be an electronic controller including a processor 116 and an associated memory 119 comprising computer-executable instructions that, when executed by the processor 116, cause the processor 116 to perform various operations. The processor 116 may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 119 may be but is not limited to a random access memory (RAM), read only memory (ROM), or other electronic, optical, magnetic or any other computer readable medium.

The controller 115 is configured to control the operation of the elevator car 103 and the beam climber system 130. For example, the controller 115 may provide drive signals to the beam climber system 130 to control the acceleration, deceleration, leveling, stopping, etc. of the elevator car 103.

The controller 115 may also be configured to receive position signals from the position reference system 113 or any other desired position reference device.

When moving up 21 or down 22 within the elevator shaft 117 along the guide rails 109*a*, 109*b*, the elevator car 103 may stop at one or more landings 125 as controlled by the controller 115. In one embodiment, the controller 115 may be located remotely or in the cloud. In another embodiment, the controller 115 may be located on the beam climber system 130. In embodiment, the controller 115 controls on-board motion control of the beam climber system 115 (e.g., a supervisory function above the individual motor controllers).

The power supply 120 for the elevator system 101 may be any power source, including a power grid and/or battery power which, in combination with other components, is supplied to the beam climber system 130. In one embodiment, power source 120 may be located on the beam climber system 130. In an embodiment, the power supply 120 is a battery that is included in the beam climber system 130.

The elevator system 101 may also include an accelerometer 107 attached to the elevator car 103 or the beam climber system 130. The accelerometer 107 is configured to detect an acceleration and/or a speed of the elevator car 103 and the beam climber system 130.

As aforementioned, the first wheel 134*a* and the second wheel 134*b* are being compressed against the first guide beam 111*a* by the first compression mechanism 150*a* and the third wheel 134*c* and the fourth wheel 134*d* are being compressed against the second guide beam by the second compression mechanism. This compression is required such that the first wheel 134*a* and second wheel 134*b*, maintain traction with the first guide beam 11*a* and the third wheel 134*c* and the fourth wheel 134*d* maintain traction with the second guide beam. This compression is fairly high to support the weight of both the elevator car 103 and the beam climber system 130. This high compression may lead to warping (also known as flat spotting) of the wheels 134*a*, 134*b*, 134*c*, 134*d* or tires 135 if the beam climber 130 and elevator car 103 are not being utilized for long durations of time. The embodiments disclosed herein seek to address this warpage by alleviating the compression on the wheels 134*a*, 134*b*, 134*c*, 134*d* and tires 135 utilizing a wheel decompression system configured to move the wheels away from the guide rails.

Figure 2:
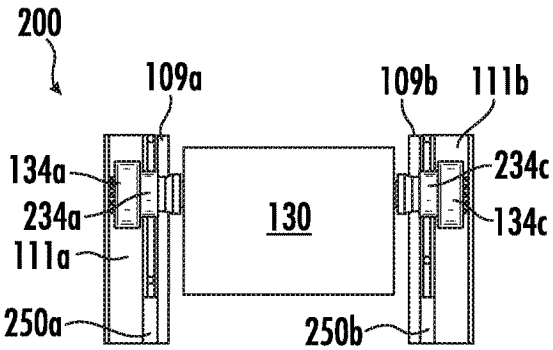
FIG. 2 illustrates a front view of a wheel decompression system, in accordance with an embodiment of the disclosure.

Referring now to FIG. 2 with continued reference to FIG. 1, a wheel decompression system 200 is illustrated, in accordance with an embodiment of the present disclosure. The wheel decompression system 200 is composed of a first separating cam 250*a* and a second separating cam 250*b*. The first separating cam 250*a* is located between the first guide beam 111*a* and the first guide rail 109*a*. The second separating cam 250*b* is located between the second guide beam 111*b* and the second guide rail 109*b*. It is understood that while the embodiments disclosed herein illustrate separating cams 250*a*, 250*b* in the aforementioned locations, the embodiments disclosed herein may also be applicable to separating cams 250*a*, 250*b* in other functional locations such as between the guide beam 111*a*, 111*b* and the elevator car 103 and/or the guide rail 109*a*, 109*b* and wall of the elevator shaft 118. When the beam climber system 130 is not required to transport the elevator car 103 and/or may be inoperable for greater than a selected period of time, the beam climber system 130 may move itself to the wheel decompression system 200 and the wheel decompression system 200 is configured to lift the wheels 134*a*, 134*b*, 134*c*, 134*d* away from the guide beams 111*a*, 111*b*, while the beam climber system 130 is held in place. The wheel decompression system 200 accomplishes this through the use of the separating cams 250*a*, 250*b* and a first backup wheel 234*a*, a second backup wheel (see FIGS. 4 and 5), a third backup 234*c*, and a fourth back up wheel 134*d* (see FIGS. 4 and 5).

The wheel decompression system 200 may be located at a top of an elevator shaft 117, at the bottom of the elevator shaft 117, in the middle of the elevator shaft 117, in a parking area for elevator cars 103 and/or beam climber systems 130, a transfer carriage/vehicle for elevator cars 103 and/or beam climber systems 130, and/or in a transfer station for elevator cars 103 and/or beam climber systems 130.

Figure 5:
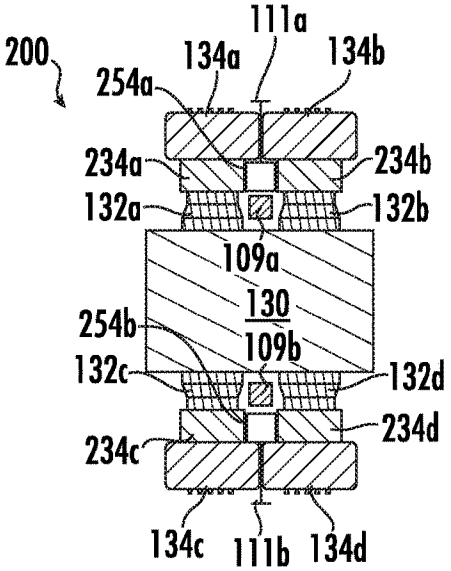
FIG. 5 illustrates a top view of the wheel decompression system of FIG. 2, in accordance with an embodiment of the disclosure.
Figure 4:
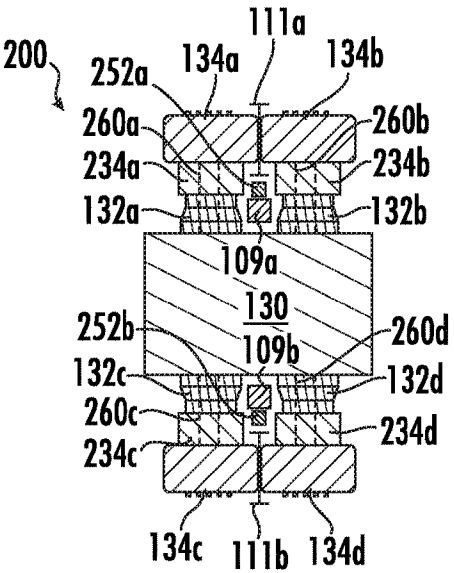
FIG. 4 illustrates a top view of the wheel decompression system of FIG. 2, in accordance with an embodiment of the disclosure.
Figure 3:
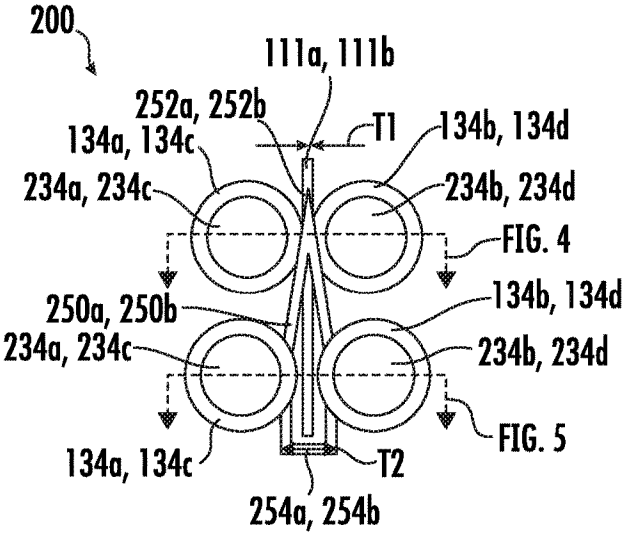
FIG. 3 illustrates a side view of the wheel decompression system of FIG. 2, in accordance with an embodiment of the disclosure.

Referring now to FIGS. 3-5 with continued reference to FIGS. 1 and 2, the wheel decompression system 200 is illustrated, in accordance with an embodiment of the present disclosure. As illustrated in FIG. 3, the first separating cam 250*a* and the second separating cam 250*b* are fixed and wedge shaped. The separating cam 250*a*, 250*b* may also be diamond shaped. As aforementioned, the first separating cam 250*a* is located between the first guide beam 111*a* and the first guide rail 109*a*. The second separating cam 250*b* is located between the second guide beam 111*b* and the second guide rail 109*b*.

The first backup wheel 234*a* is operably connected to the first wheel 134*a* such that when the first backup wheel 234*a* moves away from the first guide beam 111*a* the first wheel 134*a* also moves away. The second backup wheel 234*b* is operably connected to the second wheel 134*b* such that when the second backup wheel 234*b* moves away from the first guide beam 111*a* the second wheel 134*b* also moves away.

The first wheel 134*a*, the first electric motor 132*a*, and the first backup wheel 234*a* are located on a first axle 260*a*. The second wheel 134*b*, the second electric motor 132*b*, and the second backup wheel 234*b* are located on a second axle 260*b*. The first separating cam 250*a* includes a first end 252*a* and a second end 254*a* opposite the first end 252*a*. The first end 252*a* has a first thickness T1 and the second end 254*a* has a second thickness T2. The second thickness T2 is greater than the first thickness T1 such that the first separating cam 250*a* is wedge shaped or diamond shaped. When the controller 115 determines that decompression of the wheels 134*a*, 134*b* is required the controller 115 will command the beam climber system 130 to roll onto the first end 252*a* of the separating cam 250*a*. As the first backup wheel 234*a* and the second backup wheel 234*b* roll from the first end 252 to the second end 254*a*, the first backup wheel 234*a* and the second backup wheel 234*b* will slowly increase in separation as the first separating cam 250*a* pushes them apart and compresses the first compression mechanism 150*a*. It should be noted that if the first compression mechanism 150*a* is an actuated device providing a variable amount of compression using an actuated compression force, the first compression mechanism 150*a* may have to relieve the actuated compression force for the first separating came to push the first backup wheel 234*a* and the second backup wheel 234*b* apart. Since the first wheel 134*a* and the first backup wheel 234*a* are located on the same axle (i.e., the first axle 260*a*) and the second wheel 134*b* and the second backup wheel 234*b* are located on the same axle (i.e., the second axle 260*b*) when the first backup wheel 234*a* separates from the second backup wheel 234*b* then the first wheel 134*a* and the second wheel 134*b* will also separate and lift away from the first guide beam 111*a*.

The third backup wheel 234*c* is operably connected to the third wheel 134*c* such that when the third backup wheel 234*c* moves away from the second guide beam 111*b* the third wheel 134*c* also moves away. The fourth backup wheel 234*d* is operably connected to the fourth wheel 134*d* such that when the fourth backup wheel 234*d* moves away from the second guide beam 111*b* the fourth wheel 134*d* also moves away.

The third wheel 134*c*, the third electric motor 132*c*, and the third backup wheel 234*c* are located on a third axle 260*c*. The fourth wheel 134*d*, the fourth electric motor 132*d*, and the fourth backup wheel 234*d* are located on a fourth axle 260*d*. The second separating cam 250*b* includes a first end 252*b* and a second end 254*b* opposite the first end 252*b*. The first end 252*b* has a first thickness T1 and the second end 254*b* has a second thickness T2. The second thickness T2 is greater than the first thickness T1 such that the second separating cam 250*b* is wedge shaped or diamond shaped. When the controller 115 determines that decompression of the wheels 134*a*, 134*b* is required the controller 115 will command the beam climber system 130 to roll onto the first end 252*b* of the separating cam 250*a*. As the third backup wheel 234*c* and the fourth backup wheel 234*d* roll from the first end 252 to the second end 254*b*, the third backup wheel 234*c* and the fourth backup wheel 234*d* will slowly increase in separation as the second separating cam 250*b* pushes them apart and compresses the second compression mechanism 150*b*. It should be noted that if the second compression mechanism 150*b* is an actuated device providing a variable amount of compression using an actuated compression force, the second compression mechanism 150*b* may have to relieve the actuated compression force for the first separating came to push the third backup wheel 234*c* and the fourth backup wheel 234*d* apart. Since the third wheel 134*c* and the third backup wheel 234*c* are located on the same axle (i.e., the third axle 260*c*) and the fourth wheel 134*d* and the fourth backup wheel 234*d* are located on the same axle (i.e., the fourth axle 260*d*) when the third backup wheel 234*c* separates from the fourth backup wheel 234*d* then the third wheel 134*c* and the fourth wheel 134*d* will also separate and lift away from the second guide beam 111*b*.

Also, advantageously, the embodiments disclosed herein save electrical energy by avoiding the need to keep the beam climber system 130 in constant operation to avoid flat spots in the wheels 134*a*, 134*b*, 134*c*, 134*d* and/or tires 135.

Figure 6:
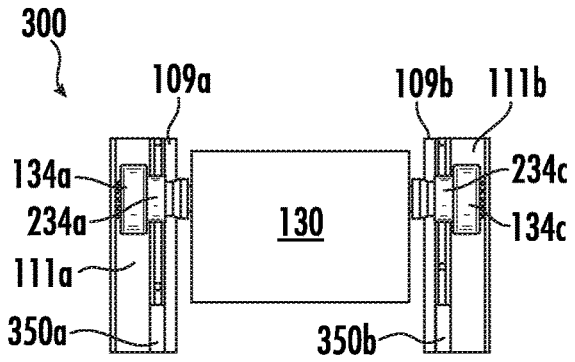
FIG. 6 illustrates a front view of a wheel decompression system, in accordance with an embodiment of the disclosure.

Referring now to FIG. 6 with continued reference to FIG. 1, a wheel decompression system 300 is illustrated, in accordance with an embodiment of the present disclosure. The wheel decompression system 300 is composed of a first separating cam 350*a* and a second separating cam 350*b*. The first separating cam 350*a* is located between the first guide beam 111*a* and the first guide rail 109*a*. The second separating cam 350*b* is located between the second guide beam 111*b* and the second guide rail 109*b*. It is understood that while the embodiments disclosed herein illustrate separating cams 350*a*, 350*b* in the aforementioned locations, the embodiments disclosed herein may also be applicable to separating cams 250*a*, 250*b* in other functional locations such as between the guide beam 111*a*, 111*b* and the elevator car 103 and/or the guide rail 109*a*, 109*b* and wall of the elevator shaft 118. When the beam climber system 130 is not required to transport the elevator car 103 and/o may be inoperable for greater than a selected period of time, the beam climber system 130 may move itself to the wheel decompression system 300 and the wheel decompression system 300 is configured to lift the wheels 134*a*, 134*b*, 134*c*, 134*d* away from the guide beams 111*a*, 111*b*, while the beam climber system 130 is held in place. The wheel decompression system 300 accomplishes this through the use of the separating cams 350*a*, 350*b* and a first backup wheel 234*a*, a second backup wheel (see FIG. 7), a third backup 234*c*, and a fourth back up wheel 134*d* (see FIG. 7). The wheel decompression system 300 may be located at atop of an elevator shaft 117, at the bottom of the elevator shaft 117, in the middle of the elevator shaft 117, in a parking area for elevator cars 103 and/or beam climber systems 130, a transfer carriage/vehicle for elevator cars 103 and/or beam climber systems 130, and/or in a transfer station for elevator cars 103 and/or beam climber systems 130.

Figure 7:
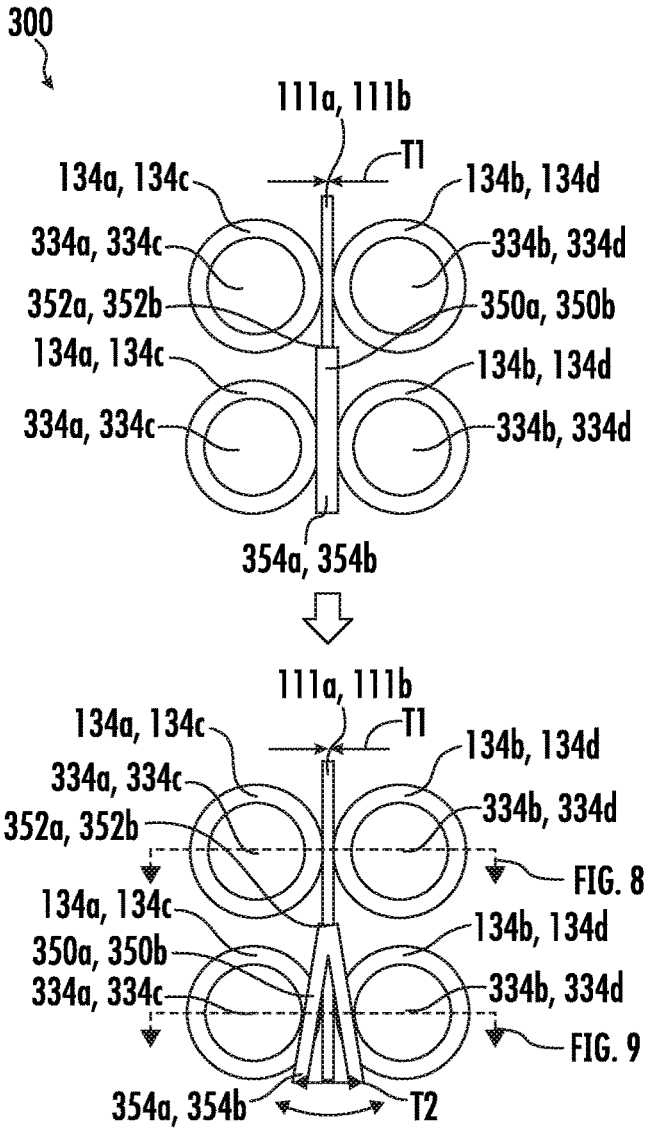
FIG. 7 illustrates a side view of the wheel decompression system of FIG. 6, in accordance with an embodiment of the disclosure.
Figure 8:
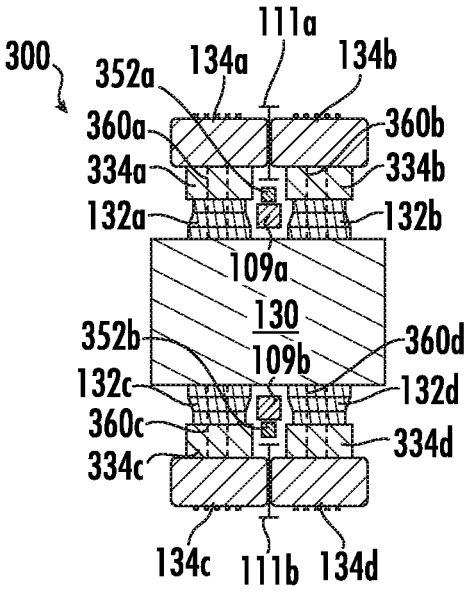
FIG. 8 illustrates a top view of the wheel decompression system of FIG. 6, in accordance with an embodiment of the disclosure.
Figure 9:
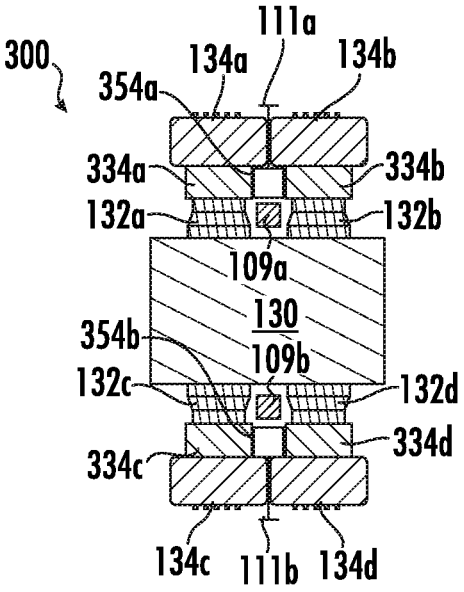
FIG. 9 illustrates a top view of the wheel decompression system of FIG. 6, in accordance with an embodiment of the disclosure.

Referring now to FIGS. 7-9, with continued reference to the previous FIGS., the wheel decompression system 300 is illustrated, in accordance with an embodiment of the disclosure. As illustrated in FIG. 7-9, the first separating cam 350*a* and the second separating cam 350*b* are not fixed, as opposed to the wheel decompression system 200 discussed above. Rather, as illustrated in FIG. 7-9, the first separating cam 350*a* and the second separating cam 350*b* are adjustable to open and close, which transformed each separating cam 350*a*, 350*b* into a wedge shape or diamond shape when open. The first separating cam 350*a* may pivot at the first end 352*a* to open and the second separating cam 350*b* may pivot at the first end 352*b* to open. The separating cams 350*a*, 350*b* may remain closed to allow the elevator car 130 to move right past them during normal operation but then open when the elevator car 130 requires decompression of the wheels 134*a*, 134*b*, 134*c*, 134*d* and the elevator car 130 is properly positioned at the separating cams 350*a*, 350*b*. The separating cams 350*a*, 350*b* may utilize actuators to open and close. The actuators may be non-backdrivable actuators, such as, for example, ball screw actuators. As aforementioned, the first separating cam 350*a* is located between the first guide beam 111*a* and the first guide rail 109*a*. The second separating cam 350*b* is located between the second guide beam 111*b* and the second guide rail 109*b*.

The first backup wheel 334*a* is operably connected to the first wheel 134*a* such that when the first backup wheel 334*a* moves away from the first guide beam 111*a* the first wheel 134*a* also moves away. The second backup wheel 334*b* is operably connected to the second wheel 134*b* such that when the second backup wheel 334*b* moves away from the first guide beam 111*a* the second wheel 134*b* also moves away.

The first wheel 134*a*, the first electric motor 132*a*, and the first backup wheel 334*a* are located on a first axle 360*a*. The second wheel 134*b*, the second electric motor 132*b*, and the second backup wheel 334*b* are located on a second axle 360*b*. The second separating cam 350*b* includes a first end 352*a* and a second end 354*a* opposite the first end 352*a*. The first end 352*a* has a first thickness T1 and the second end 354*a* has a second thickness T2. The second thickness T2 is greater than the first thickness T1 such that the second separating cam 350*b* is wedge shaped when the second separating cam 350*b* is opened. When the controller 115 determines that decompression of the wheels 134*a*, 134*b* is required the controller 115 will command the beam climber system 130 to roll onto the first end 352*a* of the separating cam 350*a*. As the first backup wheel 334*a* and the second backup wheel 334*b* roll from the first end 352 to the second end 354*a*, the first backup wheel 334*a* and the second backup wheel 334*b* will slowly increase in separation as the second separating cam 350*b* pushes them apart and compresses the first compression mechanism150*a*. It should be noted that if the first compression mechanism 150*a* is an actuated device providing a variable amount of compression using an actuated compression force, the first compression mechanism 150*a* may have to relieve the actuated compression force for the first separating came to push the first backup wheel 234*a* and the second backup wheel 234*b* apart. Since the first wheel 134*a* and the first backup wheel 334*a* are located on the same axle (i.e., the first axle 360*a*) and the second wheel 134*b* and the second backup wheel 334*b* are located on the same axle (i.e., the second axle 360*b*) when the first backup wheel 334*a* separates from the second backup wheel 334*b* then the first wheel 134*a* and the second wheel 134*b* will also separate and lift away from the first guide beam 111*a*.

The third backup wheel 334*c* is operably connected to the third wheel 134*c* such that when the third backup wheel 334*c* moves away from the second guide beam 111*b* the third wheel 134*c* also moves away. The fourth backup wheel 334*d* is operably connected to the fourth wheel 134*d* such that when the fourth backup wheel 334*d* moves away from the second guide beam 111*b* the fourth wheel 134*d* also moves away.

The third wheel 134*c*, the third electric motor 132*c*, and the third backup wheel 334*c* are located on a third axle 360*c*. The fourth wheel 134*d*, the fourth electric motor 132*d*, and the fourth backup wheel 334*d* are located on a fourth axle 360*d*. The second separating cam 350*b* includes a first end 352*b* and a second end 354*b* opposite the first end 352*b*. The first end 352*b* has a first thickness T1 and the second end 354*b* has a second thickness T2. The second thickness T2 is greater than the first thickness T1 such that the second separating cam 350*b* is wedge shaped when the second separating cam 350*b* is opened. When the controller 115 determines that decompression of the wheels 134*a*, 134*b* is required the controller 115 will command the beam climber system 130 to roll onto the first end 352*b* of the separating cam 350*a*. As the third backup wheel 334*c* and the fourth backup wheel 334*d* roll from the first end 352 to the second end 354*b*, the third backup wheel 334*c* and the fourth backup wheel 334*d* will slowly increase in separation as the second separating cam 350*b* pushes them apart and compresses the second compression mechanism150*b*. It should be noted that if the second compression mechanism 150*b* is an actuated device providing a variable amount of compression using an actuated compression force, the second compression mechanism 150*b* may have to relieve the actuated compression force for the first separating came to push the third backup wheel 234*c* and the fourth backup wheel 234*d* apart. Since the third wheel 134*c* and the third backup wheel 334*c* are located on the same axle (i.e., the third axle 360*c*) and the fourth wheel 134*d* and the fourth backup wheel 334*d* are located on the same axle (i.e., the fourth axle 360*d*) when the third backup wheel 334*c* separates from the fourth backup wheel 334*d* then the third wheel 134*c* and the fourth wheel 134*d* will also separate and lift away from the second guide beam 111*b*.

Also, advantageously, the embodiments disclosed herein save electrical energy by avoiding the need to keep the beam climber system 130 in constant operation to avoid flat spots in the wheels 134*a*, 134*b*, 134*c*, 134*d* and/or tires 135.

Figure 11:
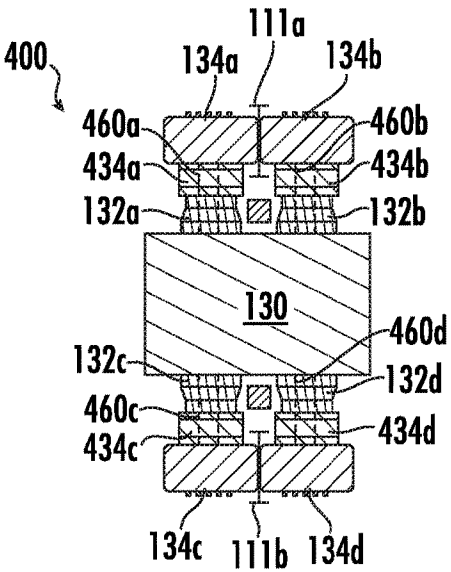
FIG. 11 illustrates a top view of the wheel decompression system of FIG. 10, in accordance with an embodiment of the disclosure.
Figure 10:
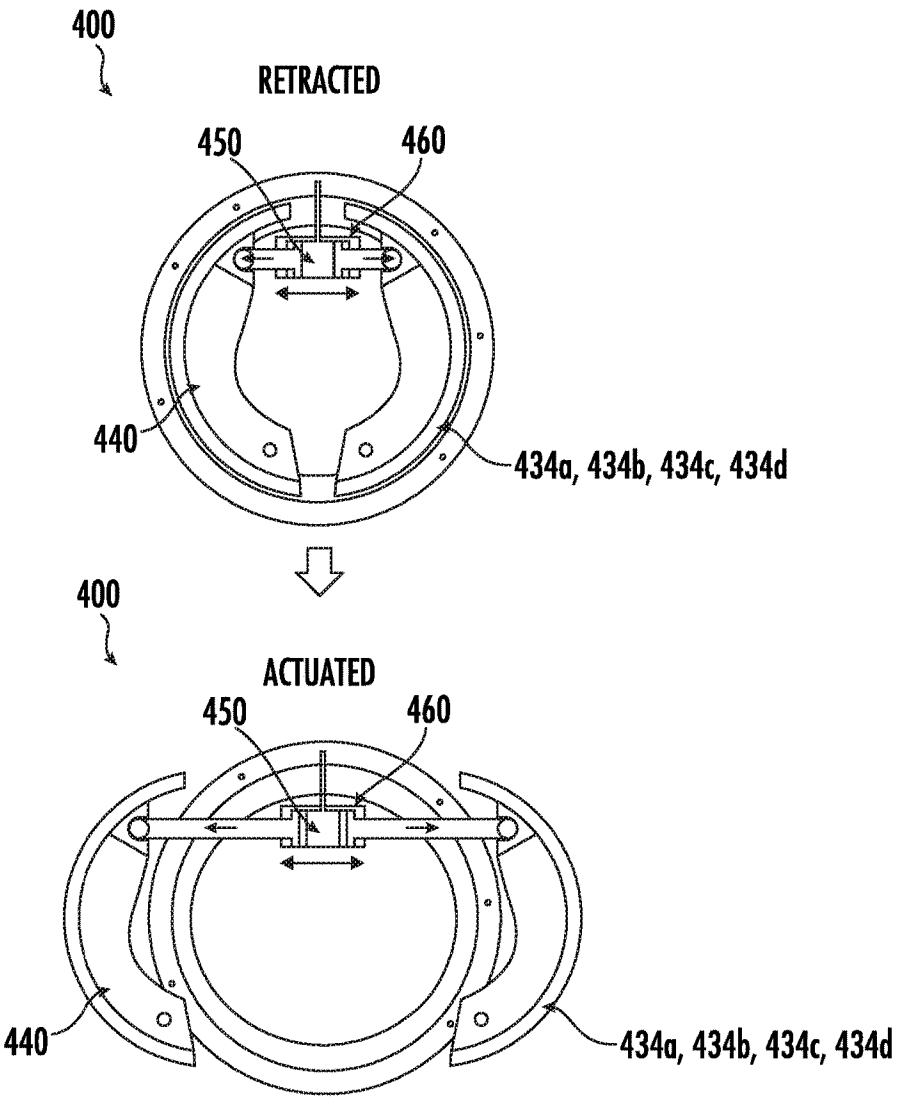
FIG. 10 illustrates a side view of an expansion wheel of a wheel decompression system, in accordance with an embodiment of the disclosure.

Referring now to FIGS. 10-11, with continued reference to FIG. 1, a wheel decompression system 400 is illustrated in accordance with an embodiment of the present disclosure. The wheel decompression system 400 includes one or more expansion wheels 434*a*, 434*b*, 434*c*, 434*d* configured to expand and push against the guide beam 111*a*, 111*b* to lift the wheels 134*a*, 134*b*, 134*c*, 134*d* away from the guide beam 111*a*, 111*b*.

The first expansion wheel 434*a* is operably connected to the first wheel 134*a* such that when the first expansion wheel 434*a* moves away from the first guide beam 111*a* the first wheel 134*a* also moves away. The second expansion wheel 434*b* is operably connected to the second wheel 134*b* such that when the second expansion wheel 434*b* moves away from the first guide beam 111*a* the second wheel 134*b* also moves away. The third expansion wheel 434*c* is operably connected to the third wheel 134*c* such that when the third expansion wheel 434*c* moves away from the second guide beam 111*b* the third wheel 134*c* also moves away. The fourth expansion wheel 434*d* is operably connected to the fourth wheel 134*d* such that when the fourth expansion wheel 434*d* moves away from the second guide beam 111*b* the fourth wheel 134*d* also moves away.

The first wheel 134*a*, the first electric motor 132*a*, and the first expansion wheel 434*a* are located on a first axle 460*a*. The second wheel 134*b*, the second electric motor 132*b*, and the second expansion wheel 434*b* are located on a second axle 360*b*. The third wheel 134*c*, the third electric motor 132*c*, and the third expansion wheel 434*c* are located on a third axle 360*c*. The fourth wheel 134*d*, the fourth electric motor 132*d*, and the fourth expansion wheel 434*d* are located on a fourth axle 360*d*.

The first expansion wheel 434*a* is configured to expand to compress the compression mechanism 150*a* and push the first wheel 134*a* away from the first guide beam 111*a* to relieve the pressure from the first wheel 134*a*. The first expansion wheel 434*a* includes a force actuator 450, an engagement sensor 460, and drum wedges 440. The force actuator 450 is configured to actuate to expand the drum wedges 440 to push the first expansion wheel 434*a* away from the first guide beam 111*a*. The force actuator 450 is configured to actuate to contract the drum wedges 440 to move the first expansion wheel 434*a* towards the first guide beam 111*a*. The force actuator 450 may be a non-backdrivable actuators, such as, for example, a ball screw actuator. The force actuator 450 may be configured to slowly expand as the elevator car 103 approaches a stopping point to help slow the elevator car 103 or the force actuator 450 may wait for the elevator car 103 to stop at the stopping point and then expand. The engagement sensor 460 is configured to detect when the drum wedges 440 are engaged with the first guide beam 111*a*. Since the first wheel 134*a* and the first expansion wheel 434*a* are located on the same axle (i.e., the first axle 460*a*) when the first expansion wheel 434*a* expands then the first wheel 134*a* will lift away from the first guide beam 111*a*.

The second expansion wheel 434*b* is configured to expand to compress the compression mechanism 150*a* and push the second wheel 134*b* away from the first guide beam 111*a* to relieve the pressure from the second wheel 134*b*. The second expansion wheel 434*b* includes a force actuator 450, an engagement sensor 460, and drum wedges 440. The force actuator 450 is configured to actuate to expand the drum wedges 440 to push the second expansion wheel 434*b* away from the first guide beam 111*a*. The force actuator 450 is configured to actuate to contract the drum wedges 440 to move the second expansion wheel 434*b* towards the first guide beam 111*a*. The force actuator 450 may be a non-backdrivable actuators, such as, for example, a ball screw actuator. The force actuator 450 may be configured to slowly expand as the elevator car 103 approaches a stopping point to help slow the elevator car 103 or the force actuator 450 may wait for the elevator car 103 to stop at the stopping point and then expand. The engagement sensor 460 is configured to detect when the drum wedges 440 are engaged with the first guide beam 111*a*. Since the second wheel 134*b* and the second expansion wheel 434*b* are located on the same axle (i.e., the first axle 460*a*) when the second expansion wheel 434*b* expands then the second wheel 134*b* will lift away from the first guide beam 111*a*.

The third expansion wheel 434*c* is configured to expand to compress the compression mechanism 150*a* and push the third wheel 134*c* away from the second guide beam 111*b* to relieve the pressure from the third wheel 134*c*. The third expansion wheel 434*c* includes a force actuator 450, an engagement sensor 460, and drum wedges 440. The force actuator 450 is configured to actuate to expand the drum wedges 440 to push the third expansion wheel 434*c* away from the second guide beam 111*b*. The force actuator 450 is configured to actuate to contract the drum wedges 440 to move the third expansion wheel 434*c* towards the second guide beam 111*b*. The engagement sensor 460 is configured to detect when the drum wedges 440 are engaged with the second guide beam 111*b*. Since the third wheel 134*c* and the third expansion wheel 434*c* are located on the same axle (i.e., the first axle 460*a*) when the third expansion wheel 434*c* expands then the third wheel 134*c* will lift away from the second guide beam 111*b*.

The fourth expansion wheel 434*d* is configured to expand to compress the compression mechanism 150*a* and push the fourth wheel 134*d* away from the second guide beam 111*b* to relieve the pressure from the fourth wheel 134*d*. The fourth expansion wheel 434*d* includes a force actuator 450, an engagement sensor 460, and drum wedges 440. The force actuator 450 is configured to actuate to expand the drum wedges 440 to push the fourth expansion wheel 434*d* away from the second guide beam 111*b*. The force actuator 450 is configured to actuate to contract the drum wedges 440 to move the fourth expansion wheel 434*d* towards the second guide beam 111*b*. The engagement sensor 460 is configured to detect when the drum wedges 440 are engaged with the second guide beam 111*b*. Since the fourth wheel 134*d* and the fourth expansion wheel 434*d* are located on the same axle (i.e., the first axle 460*a*) when the fourth expansion wheel 434*d* expands then the fourth wheel 134*d* will lift away from the second guide beam 111*b*.

Figure 12:
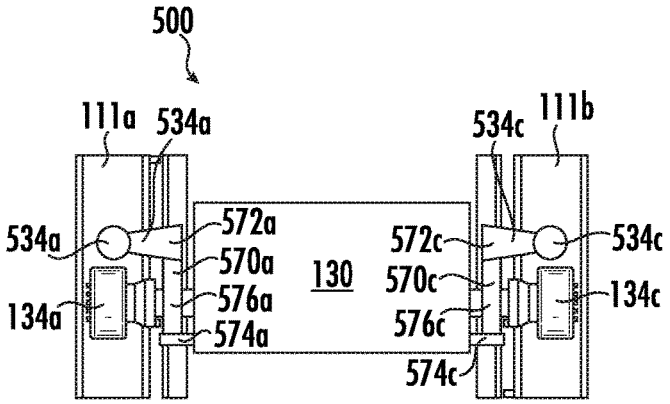
FIG. 12 illustrates a side view of a wheel decompression system, in accordance with an embodiment of the disclosure.
Figure 13:
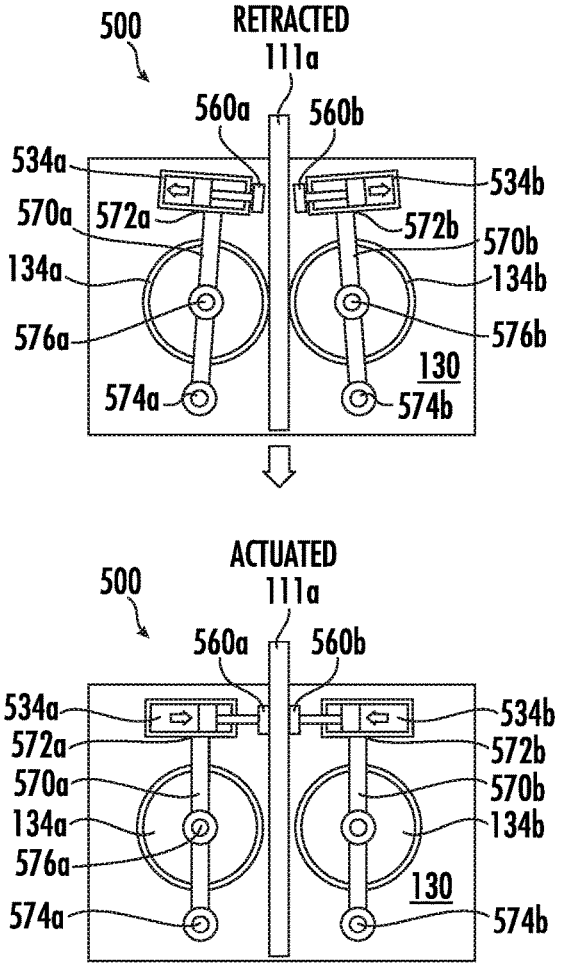
FIG. 13 illustrates a side view of the wheel decompression system of FIG. 12, in accordance with an embodiment of the disclosure.
Figure 14:
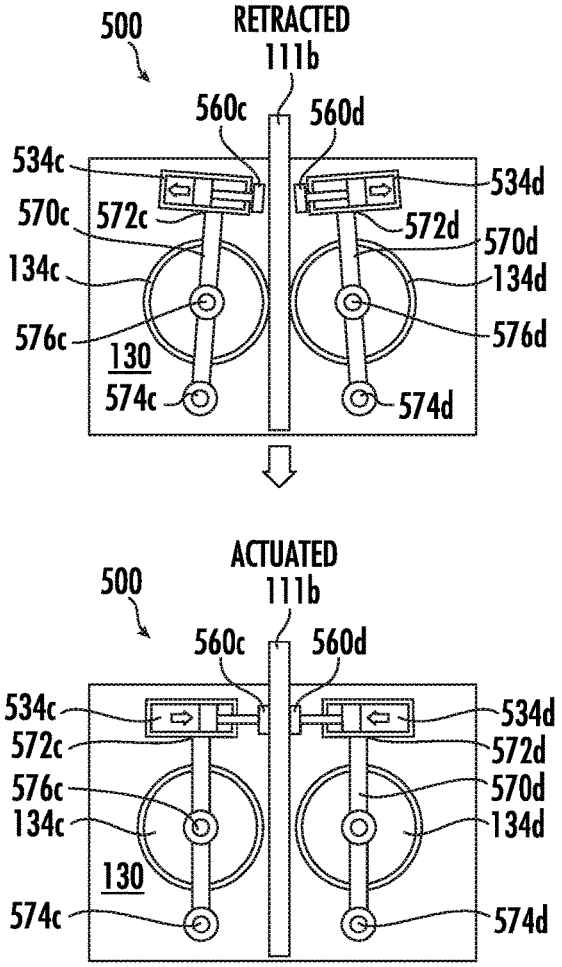
FIG. 14 illustrates a side view of the wheel decompression system of FIG. 12, in accordance with an embodiment of the disclosure.

Referring now to FIGS. 12-14, with continued reference to FIG. 1, a wheel decompression system 500 is illustrated in accordance with an embodiment of the present disclosure. The wheel decompression system 500 includes one or more linear actuators 534*a*, 534*b*, 534*c*, 534*d* configured to expand and push against the guide beam 111*a*, 111*b* to lift the wheels 134*a*, 134*b*, 134*c*, 134*d* away from the guide beam 111*a*, 111*b*.

The first linear actuator 534*a* is configured to expand to compress the compression mechanism 150*a* and push the first wheel 134*a* away from the first guide beam 111*a* to relieve the pressure from the first wheel 134*a*. The first linear actuator 534*a* includes a first support bracket 536*a*, and a first control arm 560*a*. The first linear actuator 534 is configured to actuate to expand the first control arm 560*a* to push the first linear actuator 534*a* away from the first guide beam 111*a*. The first linear actuator 534*a* is configured to actuate to contract the first control arm 560*a* to move the first linear actuator 534*a* towards the first guide beam 111*a*.

The wheel decompression system 500 further comprises a first pivot arm 570*a*. The first pivot arm 570*a* includes a first end 572*a*, a second end 574*a* located opposite the first end 572*a*, and an intermediate point 576*a* located between the first end 572*a* and the second end 574*a*. The first support bracket 536*a* is operably connected to the first pivot arm 570*a* at the first end 572*a*. The first pivot arm 570*a* is operably connected to the elevator car 103 at the second end 574*a*. The first pivot arm 570*a* may be configured to pivot about or around the second end 574*a*. The first pivot arm 570*a* is operably connected to the first wheel 134*a* at the intermediate point 576*a*.

Since the first wheel 134*a* and the first linear actuator 534*a* are operably connected when the first linear actuator 534*a* expands then the first wheel 134*a* will lift away from the first guide beam 111*a* as the first pivot arm 570*a* pivots at the second end 574*a*.

The second linear actuator 534*b* is configured to expand to compress the compression mechanism 150*b* and push the second wheel 134*b* away from the second guide beam 111*b* to relieve the pressure from the second wheel 134*b*. The second linear actuator 534*b* includes one or more second support brackets 536*b*, and a second control arm 560*b*. The second linear actuator 534 is configured to actuate to expand the second control arm 560*b* to push the second linear actuator 534*b* away from the first guide beam 111*a*. The second linear actuator 534*b* is configured to actuate to contract the second control arm 560*b* to move the second linear actuator 534*b* towards the first guide beam 111*a*.

The wheel decompression system 500 further comprises a second pivot arm 570*b*. The second pivot arm 570*b* includes a first end 572*b*, a second end 574*b* located opposite the first end 572*b*, and an intermediate point 576*b* located between the first end 572*b* and the second end 574*b*. The second support bracket 536*b* is operably connected to the second pivot arm 570*b* at the first end 572*b*. The second pivot arm 570*b* is operably connected to the elevator car 103 at the second end 574*b*. The second pivot arm 570*b* may be configured to pivot about or around the second end 574*b*. The second pivot arm 570*b* is operably connected to the second wheel 134*b* at the intermediate point 576*b*.

Since the second wheel 134*b* and the second linear actuator 534*b* are operably connected when the second linear actuator 534*b* expands then the second wheel 134*b* will lift away from the first guide beam 111*a* as the second pivot arm 570*b* pivots at the second end 574*b*.

The third linear actuator 534*c* is configured to expand to compress the compression mechanism 150*c* and push the third wheel 134*c* away from the second guide beam 111*b* to relieve the pressure from the third wheel 134*c*. The third linear actuator 534*c* includes one or more third support brackets 536*c*, and a third control arm 560*c*. The third linear actuator 534 is configured to actuate to expand the third control arm 560*c* to push the third linear actuator 534*c* away from the second guide beam 111*b*. The third linear actuator 534*c* is configured to actuate to contract the third control arm 560*c* to move the third linear actuator 534*c* towards the second guide beam 111*b*.

The wheel decompression system 500 further comprises a third pivot arm 570*c*. The third pivot arm 570*c* includes a first end 572*c*, a second end 574*c* located opposite the first end 572*c*, and an intermediate point 576*c* located between the first end 572*c* and the second end 574*c*. The second support bracket 536*b* is operably connected to the third pivot arm 570*c* at the first end 572*c*. The third pivot arm 570*c* is operably connected to the elevator car 103 at the second end 574*c*. The third pivot arm 570*c* may be configured to pivot about or around the second end 574*c*. The third pivot arm 570*c* is operably connected to the third wheel 134*c* at the intermediate point 576*c*.

Since the third wheel 134*c* and the third linear actuator 534*c* are operably connected when the third linear actuator 534*c* expands then the third wheel 134*c* will lift away from the second guide beam 111*b* as the third pivot arm 570*c* pivots at the second end 574*c*.

The fourth linear actuator 534*d* is configured to expand to compress the compression mechanism 150*d* and push the fourth wheel 134*d* away from the second guide beam 111*b* to relieve the pressure from the fourth wheel 134*d*. The fourth linear actuator 534*d* includes one or more fourth support brackets 536*d*, and a fourth control arm 560*d*. The fourth linear actuator 534 is configured to actuate to expand the fourth control arm 560*d* to push the fourth linear actuator 534*d* away from the second guide beam 111*b*. The fourth linear actuator 534*d* is configured to actuate to contract the fourth control arm 560*d* to move the fourth linear actuator 534*d* towards the second guide beam 111*b*.

The wheel decompression system 500 further comprises a fourth pivot arm 570*d*. The fourth pivot arm 570*d* includes a first end 572*d*, a second end 574*d* located opposite the first end 572*d*, and an intermediate point 576*d* located between the first end 572*d* and the second end 574*d*. The second support bracket 536*b* is operably connected to the fourth pivot arm 570*d* at the first end 572*d*. The fourth pivot arm 570*d* is operably connected to the elevator car 103 at the second end 574*d*. The fourth pivot arm 570*d* may be configured to pivot about or around the second end 574*d*. The fourth pivot arm 570*d* is operably connected to the fourth wheel 134*d* at the intermediate point 576*d*.

Since the fourth wheel 134*d* and the fourth linear actuator 534*d* are operably connected when the fourth linear actuator 534*d* expands then the fourth wheel 134*d* will lift away from the second guide beam 111*b* as the fourth pivot arm 570*d* pivots at the second end 574*d*.

It is understood that the linear actuators 534*a*, 534*b*, 534*c*, 534*d* may be any actuator, such as, for example, a hydraulic actuator, a pneumatic actuator, or any other type of actuator known to one of skill in the art.

The present invention may be a system, a method, and/or a computer program product at any possible technical detail level of integration. The computer program product may include a computer readable storage medium (or media) having computer readable program instructions thereon for causing a processor to carry out aspects of the present invention.

As described above, embodiments can be in the form of processor-implemented processes and devices for practicing those processes, such as processor. Embodiments can also be in the form of computer program code (e.g., computer program product) containing instructions embodied in tangible media (e.g., non-transitory computer readable medium), such as floppy diskettes, CD ROMs, hard drives, or any other non-transitory computer readable medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an device for practicing the exemplary embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the

What is claimed is:

1. An elevator system, the elevator system comprising:

a beam climber system configured to move an elevator car through an elevator shaft by climbing a first guide beam that extends vertically through the elevator shaft, the first guide beam comprising a first surface and a second surface opposite the first surface, the beam climber system comprising:

a first wheel in contact with the first surface; and a first electric motor configured to rotate the first wheel; and a wheel decompression system configured to move the first wheel away from the first guide beam, the wheel decompression system comprising:

a first backup wheel operably connected to and coaxial with the first wheel such that when the first backup wheel moves away from the first guide beam the first wheel also moves away; and a first separating cam located between the first guide beam and a first guide rail of the elevator system, wherein the first separating cam configured to move the first backup wheel and the first wheel away from the first guide rail when the first backup wheel rolls onto the separating cam.

2. The elevator system of claim 1, wherein the first separating cam is wedge shaped.

3. The elevator system of claim 2, wherein the first separating cam is adjustable to open and close, and wherein the first separating cam transforms into a wedge shape when opened.

4. The elevator system of claim 3, wherein the first separating cam further comprises a first end and a second end opposite the first end, wherein the first separating cam pivots at the first end to open.

5. The elevator system of claim 1, further comprising:

a first axle, wherein the first electric motor is located on the first axle, and wherein the first backup wheel is located on the first axle.

6. The elevator system of claim 1, wherein the first separating cam is fixed and wedge shaped.

7. The elevator system of claim 1, wherein the first separating cam further comprises a first end and a second end opposite the first end, the first end having a first thickness and the second end having a second thickness, wherein the second thickness is greater than the first thickness.

8. The elevator system of claim 7, wherein the first backup wheel rolls onto the separating cam at the first end.

9. The elevator system of claim 7, wherein the first separating cam is wedge shaped.

10. The elevator system of claim 1, wherein the beam climber system further comprises: a first compression mechanism configured to compress the first wheel against the first surface.

11. The elevator system of claim 10, wherein the wheel decompression system comprises:

a first expansion wheel operably connected to the first wheel such that when the first expansion wheel moves away from the first guide beam the first wheel also moves away, the first expansion wheel being configured to expand to compress the compression mechanism and push the first wheel away from the first guide beam to relieve pressure on the first wheel.

12. The elevator system of claim 11, further comprising:

a first axle, wherein the first electric motor is located on the first axle, and wherein the first expansion wheel is located on the first axle.

13. The elevator system of claim 11, wherein the first expansion wheel further comprises:

a force actuator; and one or more drum wedges, wherein the force actuator is configured to actuate to expand the drum wedges to push the first expansion wheel away from the first guide beam.

14. The elevator system of claim 13, wherein the first expansion wheel further comprises:

an engagement sensor configured to detect when the drum wedges are engaged with the first guide beam.

15. The elevator system of claim 10, wherein the wheel decompression system comprises:

a first linear actuator operably connected to the first wheel such that when the linear actuator moves away from the first guide beam the first wheel also moves away, the first linear actuator being configured to expand to compress the compression mechanism and push the first wheel away from the first guide beam to relieve pressure on the first wheel.

16. The elevator system of claim 15, wherein the first linear actuator further comprises:

a first control arm, wherein the first linear actuator is configured to actuate to expand the first control arm to push the first linear actuator away from the first guide beam.

17. The elevator system of claim 15, wherein the wheel decompression system further comprises:

a first pivot arm comprising a first end, a second end located opposite the first end, and an intermediate point located between the first end and the second end; and a first support bracket operably connected to the first pivot arm at the first end, the first pivot arm being operably connected to the elevator car at the second end, wherein the first pivot arm is operably connected to the first wheel at the intermediate point, and wherein the first pivot arm is configured to pivot about the second end.

* * * * *